US007086107B2

(12) United States Patent
Ellis et al.

(10) Patent No.: US 7,086,107 B2
(45) **Date of Patent: *Aug. 8, 2006**

(54) MATTRESS SECTION SUPPORT

(75) Inventors: Craig D. Ellis, Charleston, SC (US); Kenneth L. Kramer, Greensburg, IN (US); Jason C. Brooke, Mt. Pleasant, SC (US); Eric R. Meyer, Greensburg, IN (US); Gregory W. Branson, Batesville, IN (US); David J. Ulrich, Sunman, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/310,310

(22) Filed: Dec. 5, 2002

(65) Prior Publication Data

US 2003/0079293 A1 May 1, 2003

Related U.S. Application Data

(63) Continuation of application No. 09/571,884, filed on May 12, 2000, now Pat. No. 6,499,167, which is a continuation-in-part of application No. 09/018,452, filed on Feb. 4, 1998, now Pat. No. 6,163,903, which is a continuation of application No. 08/511,711, filed on Aug. 4, 1995, now Pat. No. 5,715,548.

(51) Int. Cl.
*A61G 7/057* (2006.01)

(52) U.S. Cl. ..... 5/722; 5/186.1; 5/400; 5/739; 5/740; 5/705; 5/710

(58) Field of Classification Search ..... 5/186.1, 5/400, 701, 705, 706, 709, 710, 722, 723, 5/727, 728, 730, 739, 740, 659, 662, 658, 5/503.1, 430

See application file for complete search history.

(56) References Cited

U.S. PATENT DOCUMENTS

| | | | | |
|---|---|---|---|---|
| 583,834 | A | | 6/1897 | Ruth |
| 2,722,017 | A | | 11/1955 | Burst et al. |
| 3,220,022 | A | | 11/1965 | Nelson |
| 3,932,903 | A | | 1/1976 | Adams et al. |
| 4,055,957 | A | | 11/1977 | Falk |
| 4,106,138 | A | | 8/1978 | Murphy |
| 4,183,015 | A | | 1/1980 | Drew et al. |
| 4,258,445 | A | | 3/1981 | Zur |
| 4,336,621 | A | | 6/1982 | Schwartz |
| 4,369,535 | A | * | 1/1983 | Ekkerink ..... 5/690 |
| 4,411,035 | A | | 10/1983 | Fenwick |
| 4,527,298 | A | | 7/1985 | Moulton |
| 4,615,058 | A | | 10/1986 | Feldt |
| 4,653,129 | A | | 3/1987 | Kuck et al. |
| 4,700,416 | A | | 10/1987 | Johansson |
| 4,716,607 | A | | 1/1988 | Johansson |

(Continued)

FOREIGN PATENT DOCUMENTS

| | | |
|---|---|---|
| AU | 163976 | 3/1955 |
| GB | 754052 | 8/1956 |

OTHER PUBLICATIONS

"A Hill–Rom Solution V–CUE Dynamic Air Therapy", Hill–Rom, Inc., 1998.

*Primary Examiner*—Michael F. Trettel
(74) *Attorney, Agent, or Firm*—Bose McKinney & Evans LLP

(57) ABSTRACT

A patient support is provided comprising a frame including a deck support and a step deck positioned on the deck support. The step deck has an upper deck, a lower deck, and a side wall, the upper deck being spaced apart from the lower deck to define a recess of the deck. The step deck includes a first section and a second section configured to articulate relative to the first section.

33 Claims, 8 Drawing Sheets

U.S. PATENT DOCUMENTS 4,759,088 A * 7/1988 Brown ..... 5/401
4,858,258 A 8/1989 Mizelle
4,858,260 A 8/1989 Failor et al.
4,914,760 A 4/1990 Hargest et al.
4,926,457 A 5/1990 Poehner et al.
4,970,738 A 11/1990 Cole
5,029,352 A 7/1991 Hargest et al.
5,036,557 A 8/1991 Fales
5,065,464 A 11/1991 Blanchard et al.
5,083,334 A 1/1992 Huck et al.
5,121,756 A 6/1992 Koledin
5,129,117 A 7/1992 Celestina et al.
5,144,707 A 9/1992 Callaway et al.
5,172,436 A 12/1992 Masuda
5,179,744 A 1/1993 Foster et al.
5,231,717 A * 8/1993 Scott et al. ..... 5/727
5,245,716 A 9/1993 Callaway et al.
5,303,435 A 4/1994 Haar et al.
5,398,354 A 3/1995 Balonick et al.
5,454,126 A 10/1995 Foster et al.
5,542,136 A 8/1996 Tappel
RE35,468 E 3/1997 Newman
5,611,096 A 3/1997 Bartlett et al.
5,642,537 A 7/1997 Johnson
5,682,631 A * 11/1997 Weismiller et al. ..... 5/618
5,692,256 A 12/1997 Kramer et al.
5,724,685 A 3/1998 Weismiller et al.
6,021,533 A 2/2000 Ellis et al.
6,499,167 B1 * 12/2002 Ellis et al. ..... 5/727

* cited by examiner

MATTRESS SECTION SUPPORT

CROSS-REFERENCE TO RELATED APPLICATION

This application is a continuation of U.S. patent application Ser. No. 09/571,884, filed May 12, 2000, now U.S. Pat. No. 6,499,167, the disclosure of which is expressly incorporated herein by reference, which is a continuation-in-part of U.S. patent application Ser. No. 09/018,542, filed Feb. 4, 1998, now U.S. Pat. No. 6,163,903, the disclosure of which is expressly incorporated herein by reference, which is a continuation of U.S. patent application Ser. No. 08/511,711, filed Aug. 4, 1995, now U.S. Pat. No. 5,715,548, the disclosure of which is expressly incorporated herein by reference.

BACKGROUND AND SUMMARY OF THE INVENTION

The present invention relates to beds. More particularly, the present invention relates to beds having a deck and a mattress positioned on the bedframe to provide a patient rest surface.

It is known to provide a bed including a bedframe having a deck. Furthermore, it is known to provide such a bed with a mattress positioned on the deck to define a patient rest surface. Typically, such mattresses have a compliant mattress section providing a resilient surface on which to support a patient.

According to the present invention, a patient support is provided comprising a frame including a deck support and a step deck positioned on the deck support. The step deck has an upper deck, a lower deck, and a side wall, the upper deck being spaced apart from the lower deck to define a recess of the deck. The step deck includes a first section and a second section configured to articulate relative to the first section.

According to another embodiment of the present invention, a patient support is provided comprising a frame including a deck support and a step deck positioned on the deck support. The step deck has an upper deck, a lower deck, and a side wall. The upper deck is spaced apart from the lower deck to define a recess of the deck. The patient support further comprises a mattress section support located on the step deck and means for aligning the mattress section support with a deck section.

According to another embodiment of the present invention, a patient support is provided comprising a frame including a deck support and a step deck positioned on the deck support. The step deck has an upper deck, a lower deck, and a side wall. The upper deck is spaced apart from the lower deck to define a recess of the deck. The patient support further comprises a mattress section support located on the step deck and a coupler coupled to the mattress section support.

According to another embodiment of the present invention, a method of converting a patient support deck from a step deck having a recess to a substantially flat deck. The method comprising the steps of: placing a mattress section support upon a step deck to substantially fill the recess in the step deck and placing a mattress upon the step deck and mattress section support.

According to yet another embodiment of the present invention, a mattress for use with a deck is provided. The mattress comprises a first section having a first width and a second section having a second width, the first section being located above the second section when positioned on a deck, the first width being about 20 percent greater than the second width.

According to another embodiment of the present invention, a mattress for use with an articulating step deck defining a recess is provided. The mattress comprises a first section having a first width, a second section positioned under the first section and having a second width less than the first width to fit in the recess of a step deck. The mattress further comprising a head end and a foot end configured to move relative to the head end during articulation of an articulating step deck.

Additional features of the disclosure will become apparent to those skilled in the art upon consideration of the following detailed description when taken in conjunction with the accompanying drawings.

BRIEF DESCRIPTION OF THE DRAWINGS

The detailed description particularly refers to the accompanying figures in which.

DETAILED DESCRIPTION OF THE DRAWINGS

Figure 1:
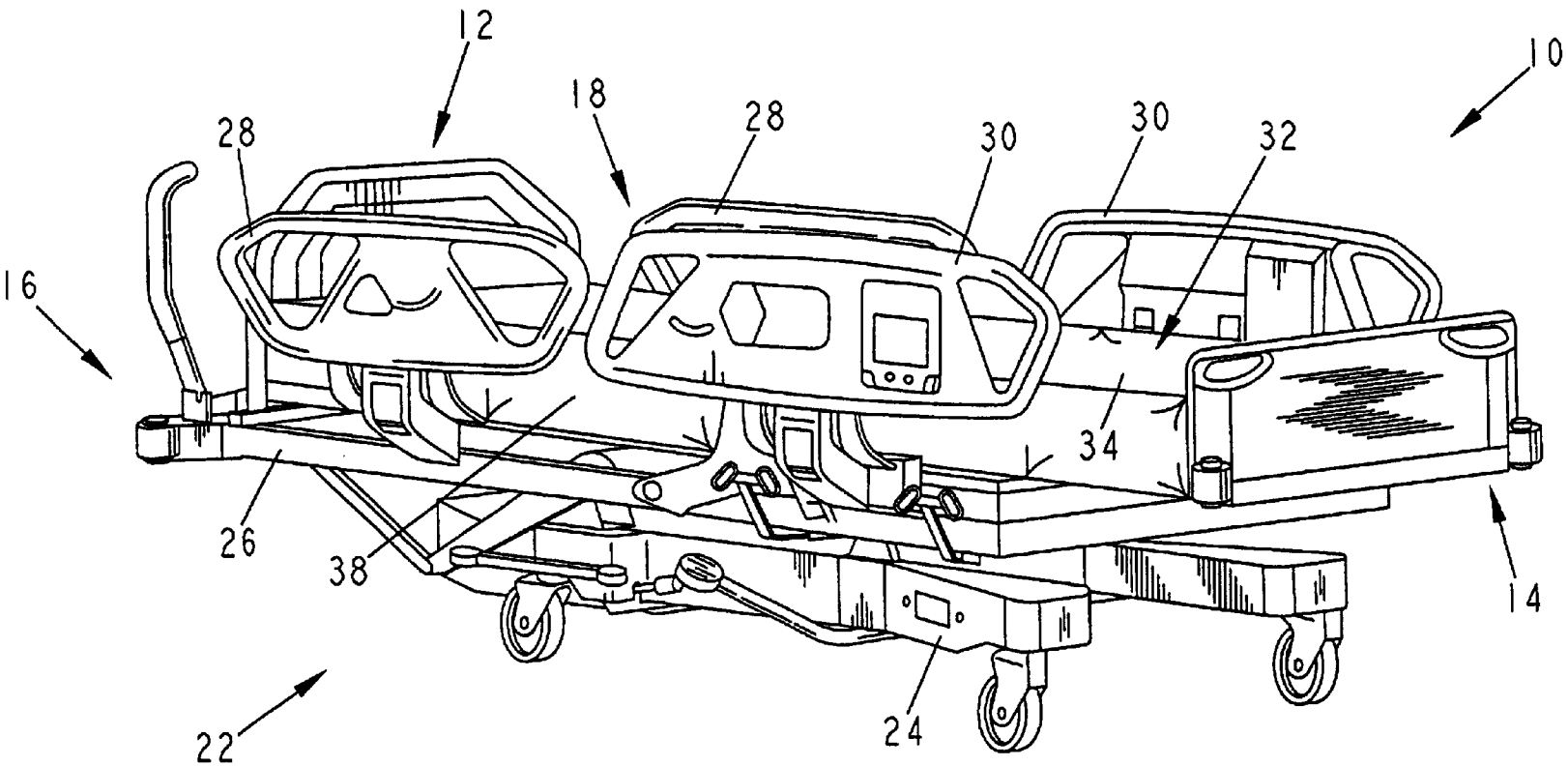
FIG. 1 is a perspective view of a hospital bed having a bedframe including a deck, a set of siderails coupled to the deck, and a mattress positioned on the deck to provide a patient rest surface.

A bed 10 in accordance with the present disclosure is provided having a head end 12, a foot end 14, and right and left sides 16, 18, as illustrated in FIG. 1. As used in this description, the phrase "head end 12" will be used to denote the end of any referred-to object that is positioned nearest to head end 12 of bed 10. Likewise, the phrase "foot end 14" will be used to denote the end of any referred-to object that is positioned nearest foot end 14 of bed 10.

Figure 2:
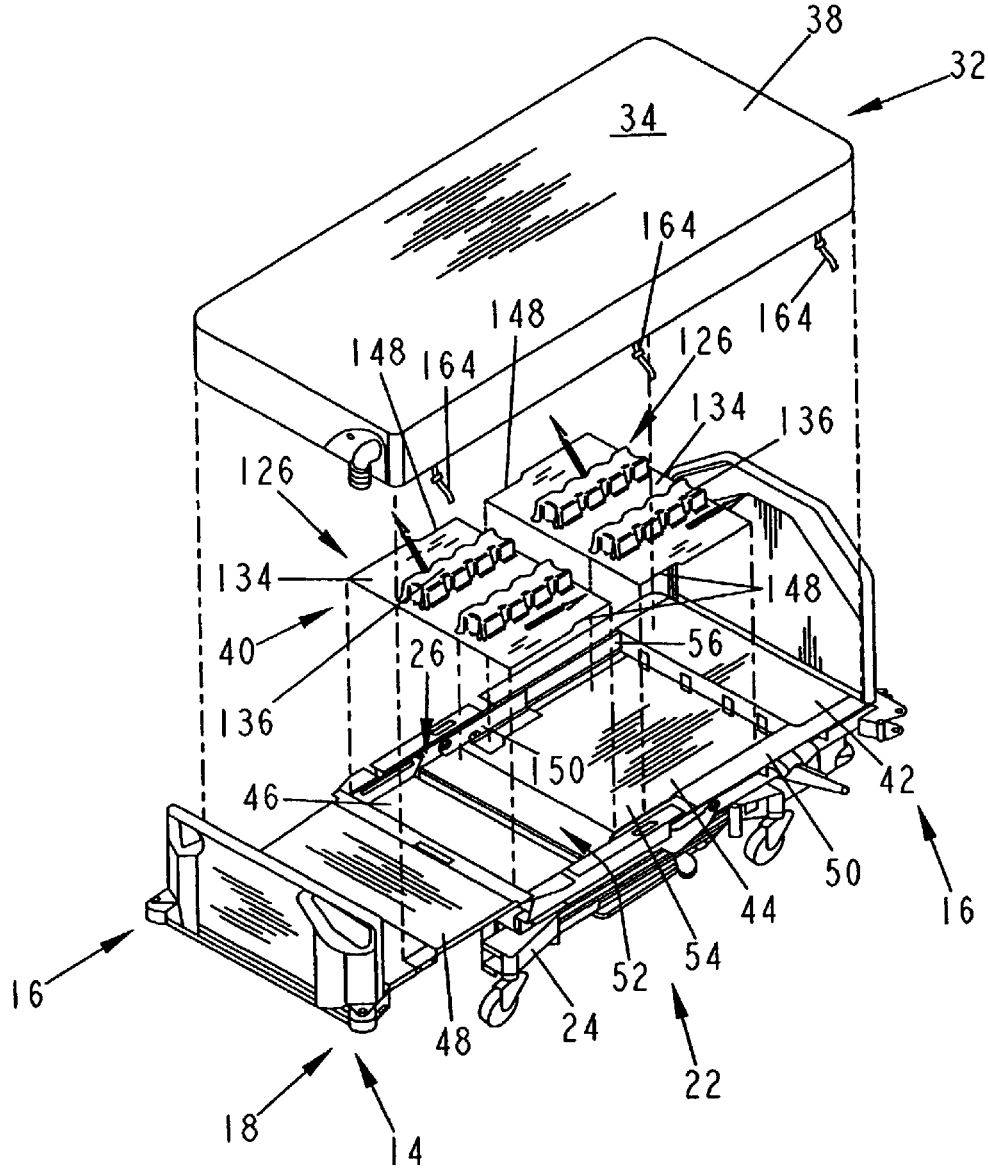
FIG. 2 is an exploded view of the bed of FIG. 1 showing the bedframe in a lowered position and the mattress including a mattress section and a pair of ridged plates positioned between the mattress section and the deck.

Bed 10 includes a bedframe 20 having a base frame 22 and a deck support or intermediate frame 24 connected to base frame 22 as shown in FIGS. 1–2. Bedframe 20 further includes a step deck 26 coupled to intermediate frame 24. Bed 10 also includes head and foot end siderails 28, 30 coupled to step deck 26 and a mattress 32 positioned on step deck 26 that provides a patient rest surface 34 to support a person (not shown).

Figure 4:
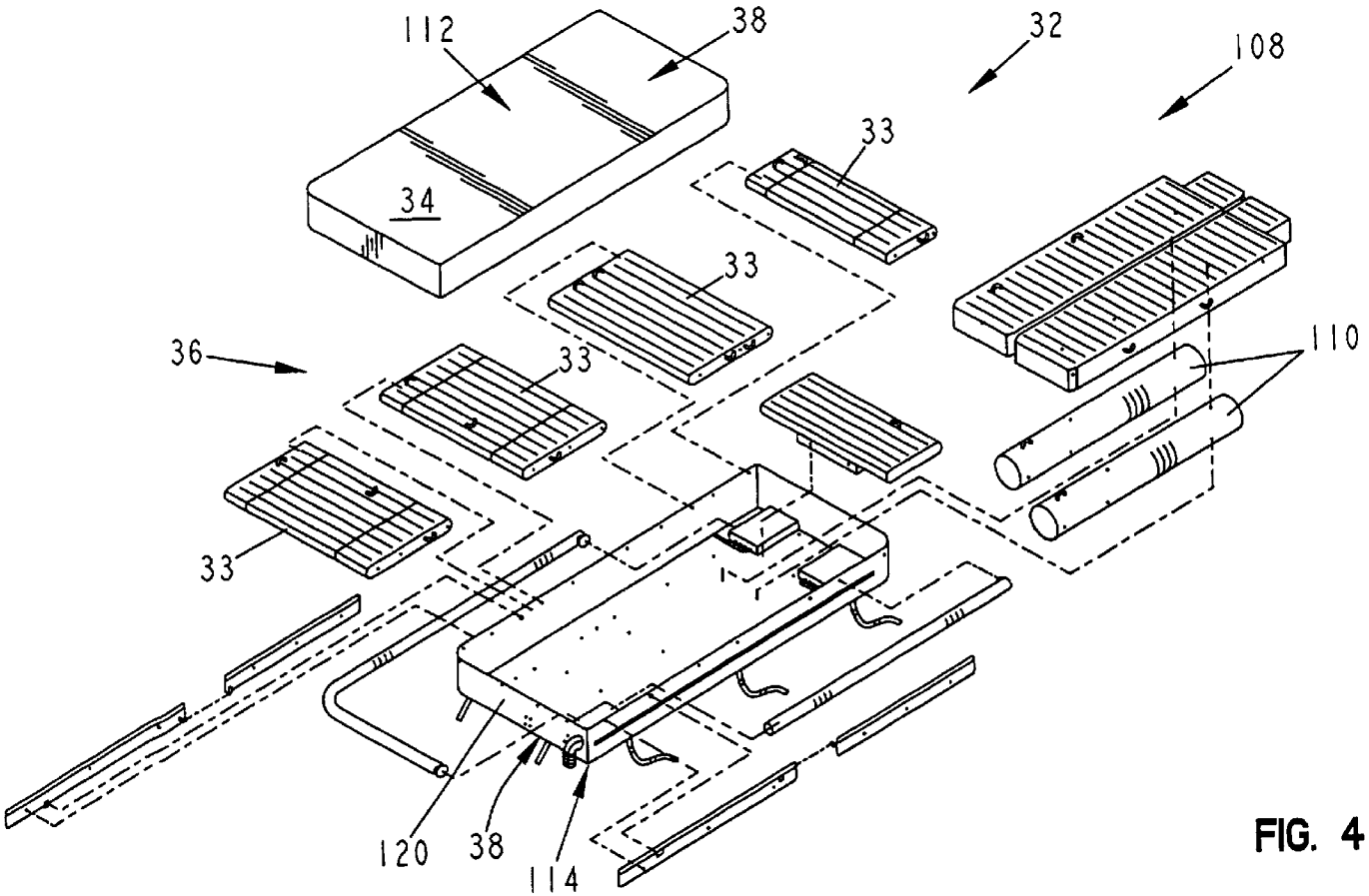
FIG. 4 is an assembly view of the mattress section showing the various components thereof.

Mattress 32 includes a mattress section 36 and a cover 38 positioned around mattress section 36 as shown in FIG. 4. Mattress section 36 is resilient to provide a patient rest surface 33. Cover 38 protects mattress section 36 from becoming soiled during use and provides patient rest surface 34 of mattress 32. Mattress 32 also includes a set of mattress section supports 40 positioned on step deck 26 to support mattress section 36 on step deck 26 as shown in FIG. 2.

Bed 10 can assume a variety of positions such as a bed position, as shown in FIG. 1, and a chair position (not shown). Articulating step deck 26 includes a head section 42, a seat section 44, a thigh section 46, and a foot section 48. During movement of bed 10 between the various positions, deck sections 42, 44, 46, 48 move relative to one another. Head section 42, thigh section 46, and foot section 48 rotate relative to each other to change the angle of inclination of the back, thighs, and lower legs of the person (not shown) with respect to seat section 46. Additional description of the articulation of step deck 26 and the mechanisms that facilitate such movement are described in U.S. Pat. No. 5,715,548 (to Weismiller, et al.) filed Aug. 4, 1995, the disclosure of which is expressly incorporated by reference herein.

Figure 7:
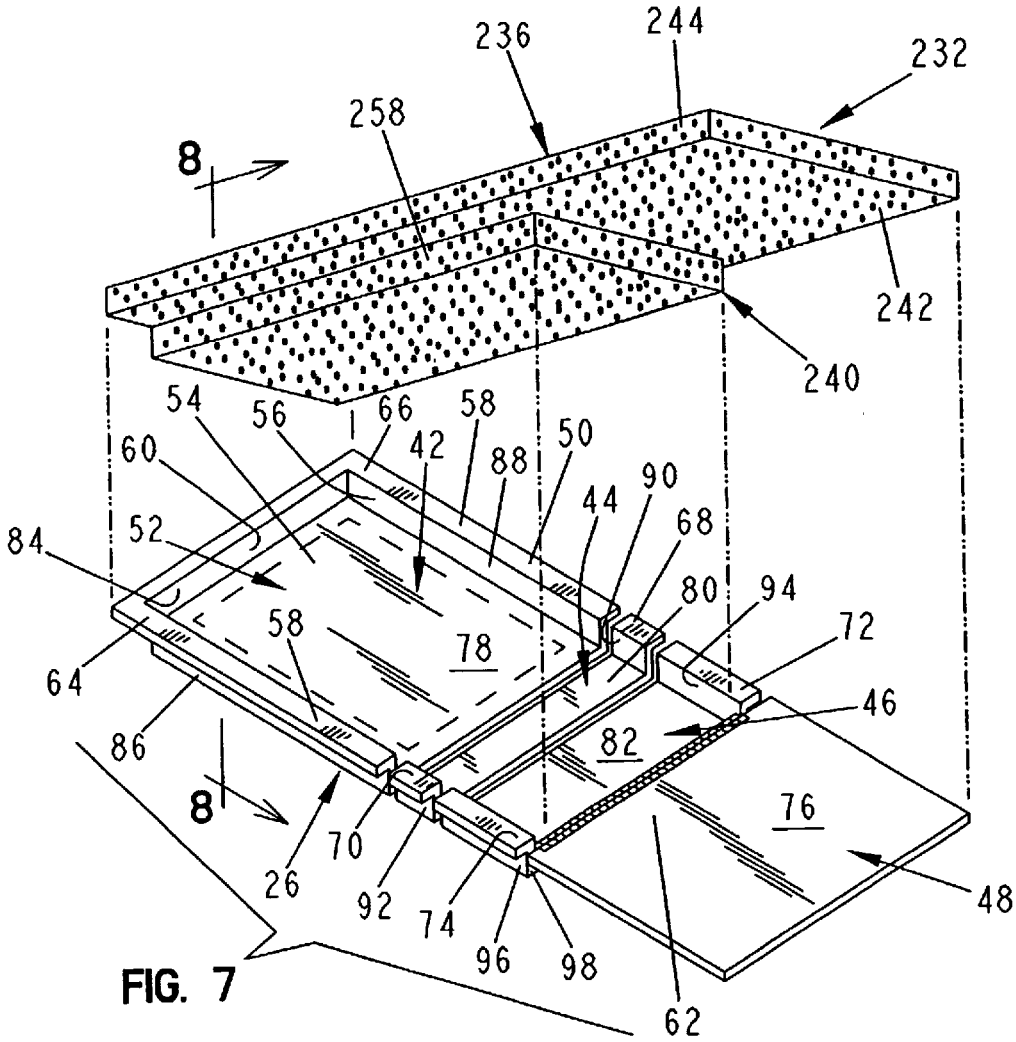
FIG. 7 is an assembly view of an alternative embodiment mattress positioned over the step deck.

Additionally, step deck 26 includes an upper deck 50 and a central, longitudinally extending recess 52 defined by a lower deck 54 of step deck 26 and a side wall 56 surrounding recess 52 and connecting lower deck 54 to upper deck 50. As shown in FIG. 7, upper deck 50 includes longitudinally extending upper deck side portions 58, a head end upper deck portion 60 appended to a head end of head section 42, a foot end upper deck portion 62 appended to a foot end of intermediate frame 24 adjacent to thigh section 46, and side upper deck portions 64, 66, 68, 70, 72, 74 appended to sides of head, seat, and thigh sections 42, 44, 46. Upper deck portions 60, 64, 66, 68, 70, 72, 74, 62 and a top surface 76 of foot section 48 are coplanar when articulating deck 26 is in the horizontal position and cooperate to form upper deck 50 which is generally parallel to intermediate frame 24.

Lower deck 54 includes a head section 78, a seat section 80, and a thigh section 82. Head, seat, and thigh sections 78, 80, 82, are coplanar when articulating deck 26 is in the horizontal position and cooperate to form lower deck 54 which is generally parallel to intermediate frame 24 and to upper deck 50 when articulating deck 26 is in the horizontal position.

Lower deck 54 is connected to upper deck 50 by side wall 56 that includes a head end wall 84 connecting head section 78 to head end upper deck portion 60, side walls 86, 88, 90, 92, 94, 96 connecting head, seat, and thigh sections 78, 80, 82 to side upper deck portions 64, 66, 68, 70, 72, 74, and a foot end wall 98 connecting thigh section 82 to foot end upper deck portion 62 as shown in FIG. 7. Step deck 26, then, comprises upper deck 50 and is formed to include central, longitudinally extending recess 52 defined by lower deck 54 and by side wall 56 connecting lower deck 54 to upper deck 50. In the preferred embodiment, foot section 48 of step deck 26 is displaced from recess 52 and forms part of upper deck 50, as shown in FIGS. 2 and 7.

Figure 9:
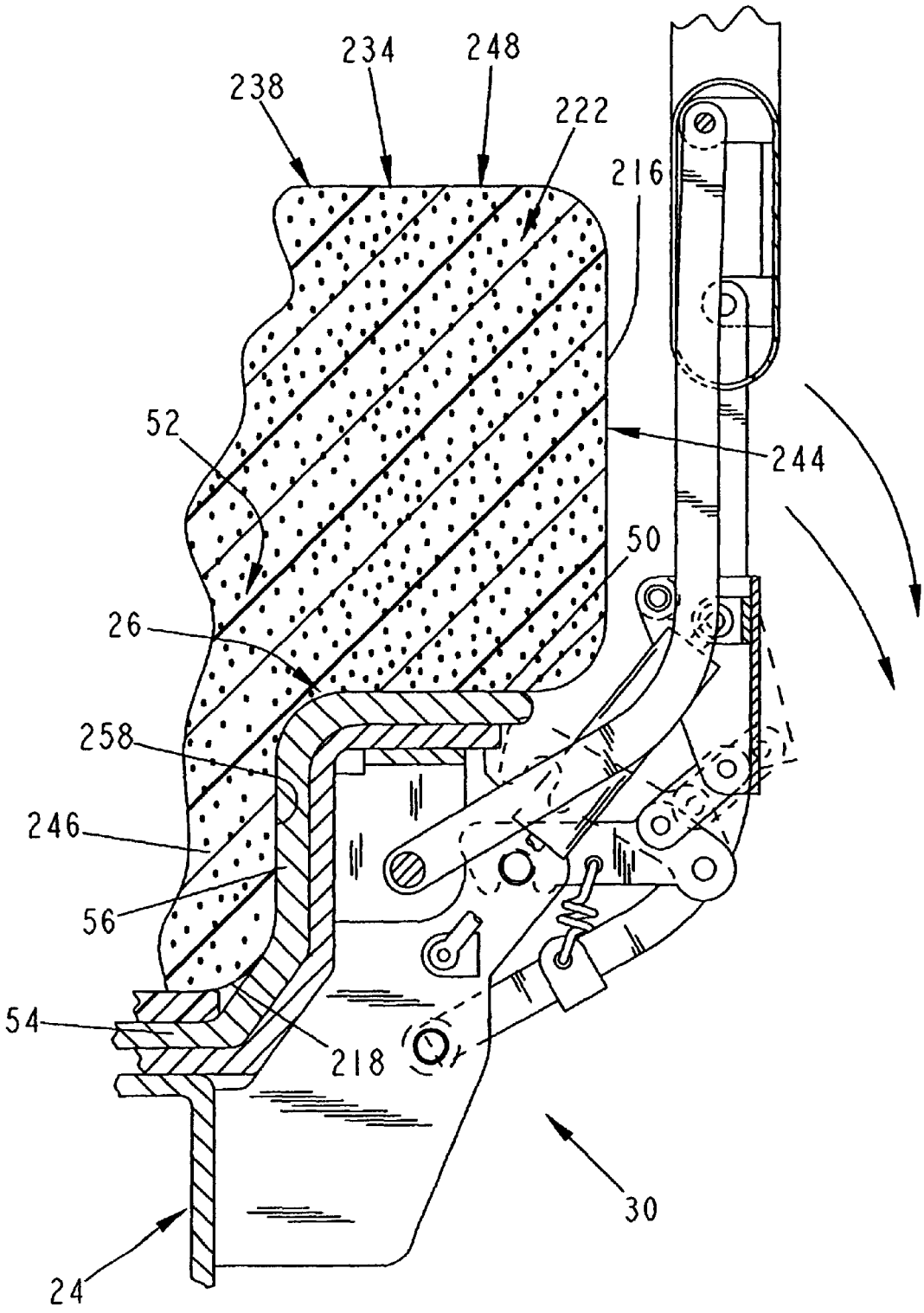
FIG. 9 is a cross-sectional view showing a siderail coupled to the articulating step deck.

Head end siderails 28 are mounted to head section 42 of articulating deck 26, and foot end siderails 30 are mounted to intermediate frame 24 adjacent to thigh section 46 of deck 26. Step deck 26 cooperates with siderails 28, 30 to maximize the height relative to the patient rest surface 34 at which siderails 28, 30 are mounted as shown in FIG. 9. The tops of siderails 28, 30 are higher when in the patient-restraining position for improved coverage and protection of the person (not shown) on patient rest surface 34 and the bottoms can be higher when in the tucked position for improved access to base frame 22 and to the space beneath intermediate frame 24.

Head end siderails 28 are mounted to move with head section 42 as head section 42 pivots relative to intermediate frame 24 between a down position and a back-support position. Foot end siderails 30 are mounted to intermediate frame 24 and do not move relative to intermediate frame 24 and seat section 44 when head, thigh, and foot sections 42, 46, 48 of articulating deck 26 move.

As shown in FIG. 4, mattress section 36 includes several inflatable bladders 108 that provide support to a patient positioned on patient rest surface 34. Mattress section 36 also includes a pair of rotational bladders 110 used during rotational therapy of a patient positioned on mattress 32. According to alternative embodiments, other configurations of mattress sections are provided using components such as low air loss bladders, foam pads, fluidized bladders, or any other configuration that provides support for a patient positioned on the mattress section. According to other alternative embodiments, the mattress section is configured to have separate portions positioned over the head, seat, thigh, and foot sections of the deck. Thus, the mattress section may either contain a single component positioned over all the sections of the deck or multiple components positioned over one or more sections of the deck.

Figure 6:
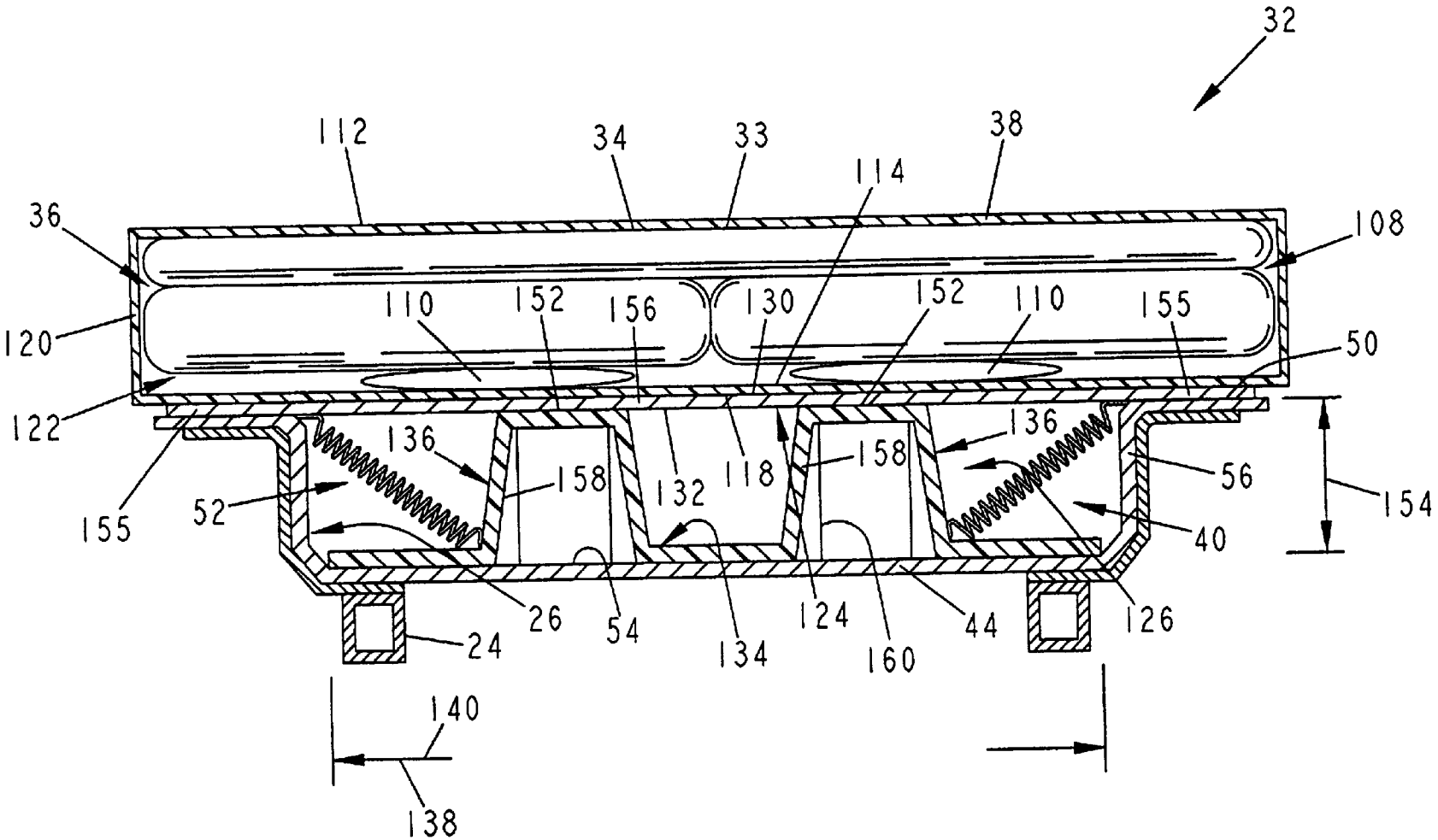
FIG. 6 is a cross-sectional view taken along line 6—6 of FIG. 5, showing the step deck, one of the flat plates positioned on the step deck; and the mattress section supported by the flat plate and one of the ridged plates.

Cover 38 includes top and bottom sections 112, 114 as shown in FIG. 6. Top section 112 defines patient rest surface 34 and protects patient rest surface 33 of mattress section 36. Bottom section 114 defines a lower surface 118 positioned over upper deck 50 and a perimeter side wall 120. Top and bottom sections 112, 114 cooperate to define an interior region 122 of cover 38 in which air bladders 108 and rotational bladders 110 are positioned. As shown in FIG. 6, mattress section supports 40 are positioned outside and below cover 38.

Series of mattress section supports 40 are configured to support mattress section 36 in a position spaced apart from lower deck 54 so that mattress section 36 is positioned outside of recess 52 as shown in FIG. 6. Series of mattress section supports 40 includes five flat plates 124 coupled to cover 38 that extend across and over recess 52 to a position on top of respective portions 60, 62, 64, 66, 68, 70, 72, 74 of upper deck 50. Flat plates 124 are substantially rigid to provide support for mattress section 36 and to facilitate sliding of mattress 32 off of step deck 26. Further description of flat plates 124 and mattress 32 is provided in U.S. Pat. No. 6,021,533 to Ellis et al., filed Aug. 25, 1997, the disclosure of which is expressly incorporated herein by reference.

Figure 5:
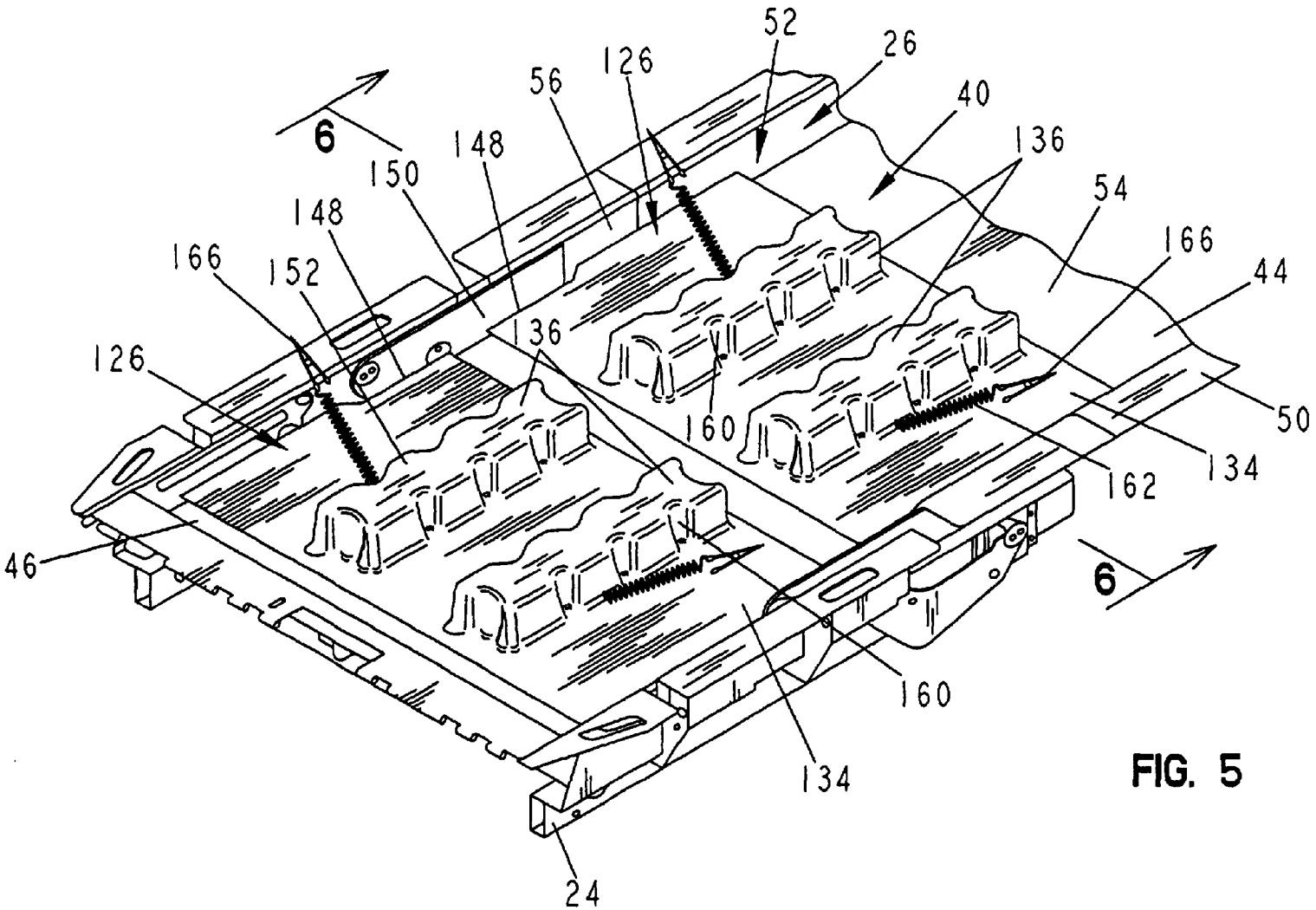
FIG. 5 is a perspective view of the step deck, with portions broken away, showing the ridged plates positioned on the step deck.

Series of substantially rigid mattress section supports 40 further include a pair of ridged plates 126 positioned on lower deck 54, as shown in FIG. 5. Ridged plates 126 extend up from lower deck 54 to support flat plates 124 and mattress section 36 so that mattress section 36 is positioned outside of recess 52 as shown in FIG. 6. According to alternative embodiments, the mattress sections are semi-rigid, partially rigid, compliance, or any other suitable stiffness.

Figure 3:
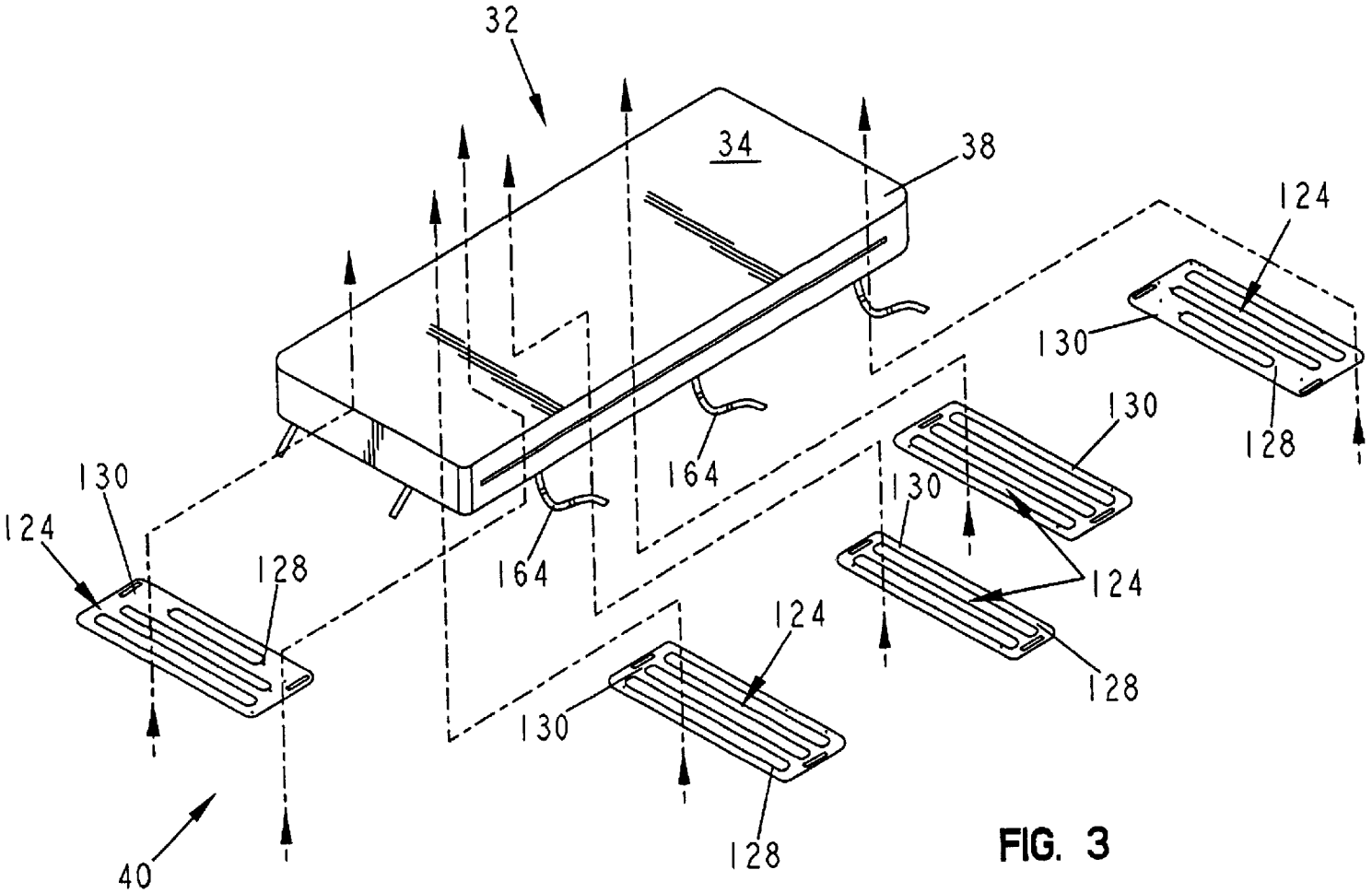
FIG. 3 is an assembly view showing the mattress section and a plurality of flat plates positioned to be coupled to the bottom of the mattress section.

Each flat plate 124 is coupled to lower surface 118 of bottom section 114 of cover 38 by snaps 128 as shown in FIG. 3. Each flat plate 124 includes an upper surface 130 positioned adjacent to lower surface 118 of top section 112 of cover 38 and a downwardly facing lower surface 132 positioned on and adjacent to upper deck 50 so that flat plates 124 are positioned between mattress section 36 and step deck 26, as shown, for example, in FIG. 6.

Each flat plate 124 is substantially rigid to support mattress 32 and to facilitate sliding of mattress section 36 off of step deck 26. When a patient is positioned on mattress 32, flat plates 124 may bow under the weight of the patient so that a portion of mattress section 36 is positioned in recess 52. Ridged plates 126 are provided to provide additional support for mattress section 36 so that flat plates 124 bow only slightly, or not at all, when a patient is positioned on mattress section 36. Rigid plates 126 also provide support to plates 124 and mattress section 36 when mattress section 36 is slid off of step deck 26. According to alternative embodiments of the present disclosure, ridged plates are not provided so that flat plates are the only support of the mattress section over the lower deck.

As shown in FIGS. 5 and 6, ridged plates 126 are positioned on lower deck 54 of step deck 26 within recess 52. Each ridged plate 126 includes a base 134 positioned on lower deck 54 and a pair of upwardly extending ridges 136. Base 134 has a length 138 substantially equal to an internal width 140 of lower deck 54 and a length 142 of sections 78, 80, 82. Base 134 also includes a width that is slightly less than a width of respective sections 78, 80, 82. Thus, each base 134 covers a substantial portion of the respective deck sections 78, 80, 82 of lower deck 54.

As shown in FIGS. 2 and 5, each base 134 includes a pair of notches 148 sized to provide clearance for hinges 150 of step deck 26. Ridges 136 cooperate to define a top surface 152 of ridged plates 126 that has a height 154 substantially equal to a height of side walls 156 of step deck 26 so that top surface 152 of ridged plates 126 is substantially coplanar with upper deck 50 as shown in FIG. 6. Because upper deck 50 and top surface 152 of ridged plates 126 are coplanar, perimeter portions 155 and middle portions 156 of flat plates 124 are supported at substantially the same height. Side walls 158 of ridged plates 126 are provided with corrugations 160 to provide additional rigidity to ridges 136.

As shown in FIG. 6, ridged plates 126 do not fill recess 52 so that a substantial portion of recess 52 remains a void. According to alternative embodiments, substantially rigid members are provided that substantially fill recess 52.

Ridged plates 126 are also provided with tethers 162 coupled near the bottom of ridges 136 and to straps 164 of mattress section 32. Tethers 162 align ridged plates 124 with deck sections 78, 80, 82 so that during articulation of step deck 26, ridged plates 126 remain in proper orientation. One end of each tether 162 is provided with a clip 166 to facilitate attachment of tethers 162 to straps 168.

A mattress 232 according to an alternative embodiment is shown in FIG. 7. Mattress 232 includes a mattress section 236 having a generally upwardly-facing sleeping surface 234 and a bottom surface 242 that is generally parallel to sleeping surface 234 and that is positioned beneath sleeping surface 234. A perimetral side 244 connects sleeping surface 234 and bottom surface 242. A mattress section support 240 is appended to bottom surface 242 of mattress section 236 and extends downwardly therefrom. Preferably, mattress section support 240 is spaced-apart from sides 244 of mattress section 236 and nests in recess 52. Mattress section support 240 may engage side wall 56 of step deck 26 to prevent movement of mattress section 236 relative to step deck 26 and to maintain the generally central position of mattress 232 on deck 26.

Because mattress section support 240 is positioned under mattress section 236, mattress section support 240 prevents a substantial portion of mattress section 236 from sagging into recess 52 when no patient is positioned on bed 10. Thus, mattress section support 240 positions mattress section 236 in a location spaced apart from lower deck 54. However, when a patient is positioned on bed 10, the weight of the patient will compress mattress section 236 and mattress section support 240 permitting a portion of mattress section 236 to sag into recess 52. Thus, mattress section support 240 is compliant to provide resilient support of mattress section 236. According to alternative embodiments, the mattress section support positioned in the cover is rigid, semi-rigid, partially rigid, or any other suitable stiffness.

Figure 8:
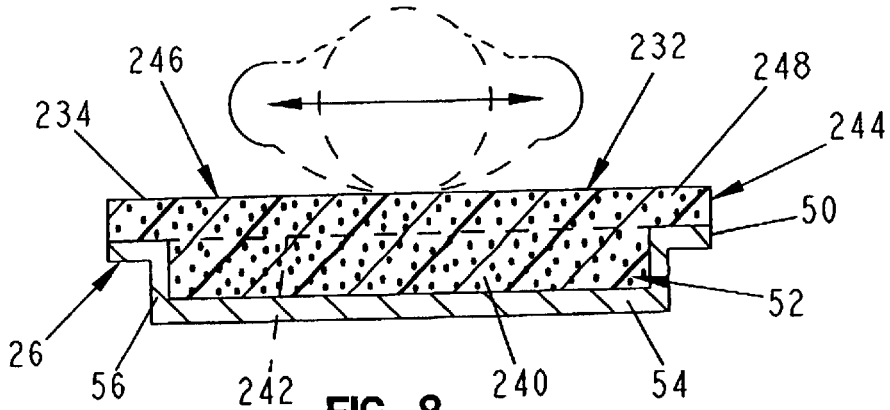
FIG. 8 is a cross-sectional view taken along line 8—8 of FIG. 7 showing the mattress of FIG. 7 positioned in the step deck.

Preferably, mattress section 236 and mattress section support 240 cooperate to provide mattress 232 with a thick zone 246 positioned partially within recess 52. Mattress section 236 provides mattress 232 with a thin zone 248 engaging upper deck 50 as shown in FIG. 8. For example, thick zone 246 can be one and one-half times the thickness of thin zone 248. In one preferred embodiment, the thick zone is approximately 7½ inches (19 cm) thick and the thin zone is 5 inches (12.7 cm) thick. Thick zone 246 is positioned to carry the majority of the weight of a person (shown in phantom) supported on sleeping surface 234 to maximize the comfort of the person. Having perimetral thin zone 248 provides a perimetral portion of mattress 232 that appears to the person on sleeping surface 234 to be firmer than thick zone 246, facilitating entry onto and exit from sleeping surface 234 along sides 244 of mattress 232.

Thinner perimetral zone 248 and upper deck side portions 58 cooperate to define edges that provide greater firmness around the edges of sleeping surface 234 as the result of sleeping surface 234 being in close proximity to upper deck 50. This increased firmness is advantageous when the person enters and exits the bed along the sides of the bed. Additionally, the edges provide a firm edge that cooperates with siderails 28, 30 to minimize the potential for side rail entrapment, in which an object becomes wedged between sleeping surface 234 and one of siderails 28, 30.

Mattress section support 240 includes a side wall 258 that can be configured to engage at least portions of side wall 56 of step deck 26 as shown in FIG. 8, thereby preventing lateral and longitudinal sliding of mattress 232 relative to step deck 26. Also, mattress section 236 includes sides 244 connecting sleeping surface 234 and bottom surface 242. Mattress 232 and step deck 26 are configured so that sides 244 of mattress section 236 are exposed above deck 26 as shown in FIGS. 8 and 9 providing the caregiver greater and easier access to mattress 232, rather than engaging a portion of a frame or upstanding walls of a deck as is found with conventional mattress and deck systems.

Mattress section 236 and mattress section support 240 may be provided in more than one piece, for example, mattress 232 may comprise a first mattress piece fit into recess 52 and a second mattress piece surrounding and abutting sides of the first mattress piece and engaging upper deck 50, or a first mattress piece (the mattress section support) could fit into recess 52 and a second mattress piece (the mattress section) having a planar bottom surface could fit over the first mattress piece so that the bottom of the second mattress piece engages the first mattress piece and upper deck 50. However, a one-piece mattress 232 including both mattress section 236 and mattress section support 240 is preferred.

Mattress 232 further includes a cover 238 defining upper or support surface 234, a perimeter side wall 216, and a lower surface 218. Upper and lower surfaces 234, 218 and sidewall 216 cooperate to define an interior region 222 and to enclose mattress section 236 and mattress section support 240 within cover 238.

Although the invention has been described in detail with reference to preferred embodiments, variations and modifications exist within the scope and spirit of the invention as described and defined in the following claims.

What is claimed is:

1. A patient support comprising:

a frame including a deck support and a step deck positioned on the deck support, the step deck having an upper deck, a lower deck, and a side wall, the upper deck being spaced apart from the lower deck to define a recess of the deck, the step deck including a first section and a second section configured to articulate relative to the first section, and a mattress section support located on the step deck, the mattress section support being substantially non-rigid.

2. A patient support comprising:

a frame including a deck support and a step deck positioned on the deck support, the step deck having an upper deck, a lower deck, and a side wall, the upper deck being spaced apart from the lower deck to define a recess of the deck, the step deck including a first section and a second section configured to articulate relative to the first section and a siderail supported by the frame, the siderail moveable between a raised position and a lowered position, the siderail positioned below the upper deck in the lowered position, a mattress section support located on the step deck, and tethers coupled to the matress section support.

3. The patient support of claim 2, wherein the tethers removably couple to a mattress.

4. A patient support comprising:

a frame including a deck support and a step deck positioned on the deck support, the step deck having an upper deck, a lower deck, and a side wall, the upper deck being spaced apart from the lower deck to define a recess of the deck;

a mattress section support located on the step deck; and tether means for aligning the mattress section support with a deck section.

5. The patient support of claim 4, wherein the upper deck includes a lip extending from the side wall.

6. The patient support of claim 4, wherein the step deck is coupled to a substantially planar foot section.

7. A patient support comprising:

a frame including a deck support and a step deck positioned on the deck support, the step deck having an upper deck, a lower deck, and a side wall, the upper deck being spaced apart from the lower deck to define a recess of the deck;

a mattress section support located above the lower deck of the step deck; and means for aligning the mattress section support with a deck section, the step deck being coupled to a substantially planar foot section and the foot section articulating relative to the step deck.

8. A patient support comprising:

a frame including a deck support and a step deck positioned on the deck support, the step deck having an upper deck, a lower deck, and a side wall, the upper deck being spaced apart from the lower deck to define a recess of the deck;

a substantially rigid mattress section support located on the step deck; and means for aligning the mattress section support with a deck section.

9. The patient support of claim 4, further comprising a substantially non-rigid mattress supported on the step deck.

10. A patient support comprising:

a frame including a deck support and a step deck positioned on the deck support, the step deck having an upper deck, a lower deck, and a side wall, the upper deck being spaced apart from the lower deck to define a recess of the deck;

a mattress section support located on the step deck;

means for aligning the mattress section support with a deck section; and a substantially non-rigid mattress supported on the step deck, the mattress including straps coupled thereto.

11. A patient support comprising:

a frame including a deck support and a step deck positioned on the deck support, the step deck having an upper deck, a lower deck, and a side wall, the upper deck being spaced apart from the lower deck to define a recess of the deck;

a mattress section support located on the step deck; and means for aligning the mattress section support with a deck section including tethers-removably coupled to a mattress.

12. A patient support comprising:

a frame including a deck support and a step deck positioned on the deck support, the step deck having an upper deck, a lower deck, and a side wall, the upper deck being spaced apart from the lower deck to define a recess of the deck;

a mattress section support located on the step deck; and a coupler coupled to the mattress section support.

13. The patient support of claim 12, wherein the coupler orients the mattress section support with a deck section.

14. The patient support of claim 12, wherein the upper deck includes a lip extending from the side wall.

15. The patient support of claim 12, wherein the step deck is coupled to a substantially planar foot section.

16. The patient support of claim 12, wherein the mattress section support is substantially rigid.

17. The patient support of claim 12, wherein the mattress section support is substantially non-rigid.

18. The patient support of claim 17, wherein the mattress includes a strap coupled thereto.

19. The patient support of claim 18, wherein the coupler removably couples to the straps.

20. A method of converting a patient support deck from a step deck having a recess to a substantially flat deck comprising the steps of:

removing a first mattress section support and a first mattress simultaneously;

placing a second mattress section support upon a step deck to substantially fill the recess in the step deck; and placing a second mattress upon the step deck and the second mattress section support.

21. The method of claim 20, wherein placing the mattress section support upon the step deck configures the step deck to receive a mattress of substantially uniform thickness thereon.

22. A method of converting a patient support deck from a step deck having a recess to a substantially flat deck comprising the steps of:

placing a mattress section support upon a step deck to substantially fill the recess in the step deck;

placing a mattress upon the step deck and mattress section support; and coupling the mattress section support to the step deck.

23. The method of claim 22, wherein the coupling step includes removably coupling a tether to the mattress, and the tether is coupled to the mattress section support.

24. The method of claim 23, wherein the mattress includes straps to which the tethers are removably coupled.

25. A method of converting a patient support deck from a step deck having a recess to a substantially flat deck comprising the steps of:

placing a substantially rigid mattress section support upon a step deck to substantially fill the recess in the step deck; and placing a mattress upon the step deck and mattress section support.

26. The method of claim 25, wherein the mattress section support has a plurality of hollow portions.

27. The method of claim 20, wherein the placing of the mattress section support on the step deck is performed before the placing of the mattress upon the step deck.

28. A mattress for use with a deck, the mattress comprising:

a first section having a first width;

a second section having a second width, the first section being located above the second section when positioned on a deck, the first width being about 20 percent greater than the second width, the first section being removably coupled to the second section; and a tether, removably coupled to the second section, to align the second section upon the deck.

29. A mattress for use with a deck, the mattress comprising:

a first section having a first width; and a substantially rigid second section having a second width, the first section being located above the second section when positioned on a deck, the first width being about 20 percent greater than the second width.

30. A mattress for use with a deck, the mattress comprising:

first section having a first width; and a substantially hollow second section having a second width, the first section being located above the second section when positioned on a deck, the first width being about 20 percent greater than the second width.

31. A mattress for use with an articulating step deck defining a recess, the mattress comprising:

a first section having a first width;

a second section positioned under the first section and having a second width less than the first width to fit in the recess of a step deck, wherein the first and second sections are composed of a unitary piece of material, a head end; and a foot end configured to move relative to the head end during articulation of an articulating step deck.

32. A mattress for use with an articulating step deck defining a recess, the mattress comprising:

a first section having a first width;

a second section positioned under the first section and having a second width less than the first width to fit in the recess of a step deck, wherein the second section is substantially rigid;

a head end; and a foot end configured to move relative to the head end during articulation of an articulating step deck.

33. A mattress for use with an articulating step deck defining a recess, the mattress comprising:

a first section having a first width;

a second section positioned under the first section and having a second width less than the first width to fit in the recess of a step deck; straps configured to couple the mattress to the articulating step deck, a head end;

a foot end configured to move relative to the head end during articulation of an articulating step deck; and straps configured to couple the mattress to the articulating step deck.

* * * * *